US007698924B2

(12) United States Patent
Nakajima et al.

(10) Patent No.: US 7,698,924 B2
(45) Date of Patent: Apr. 20, 2010

(54) MEMBER HAVING A CHAMFERED THROUGH HOLE AND MANUFACTURING METHOD OF THE SAME

(75) Inventors: Masaki Nakajima, Anjo (JP); Hideyuki Nagai, Anjo (JP); Kazushi Nagashima, Anjo (JP); Ariyoshi Terao, Anjo (JP)

(73) Assignee: Aisin AW Co., Ltd., Anjo-shi, Aichi-ken (JP)

( * ) Notice: Subject to any disclaimer, the term of this patent is extended or adjusted under 35 U.S.C. 154(b) by 10 days.

(21) Appl. No.: 12/238,050

(22) Filed: Sep. 25, 2008

(65) Prior Publication Data

US 2009/0090156 A1 Apr. 9, 2009

(30) Foreign Application Priority Data

Sep. 26, 2007 (JP) ..... 2007-249141

(51) Int. Cl.
*B21D 28/24* (2006.01)
*B21D 28/00* (2006.01)

(52) U.S. Cl. ..... 72/333; 72/332; 72/327

(58) Field of Classification Search ..... 72/353.2, 72/355.2, 355.6, 416, 325–327, 332–334, 72/335–337

See application file for complete search history.

(56) References Cited

U.S. PATENT DOCUMENTS 2,790,477 A * 4/1957 Gargrave ..... 72/481.9
3,434,327 A * 3/1969 Speakman ..... 72/377
4,433,568 A * 2/1984 Kondo ..... 72/356
5,816,093 A 10/1998 Takeuchi et al.
6,065,322 A * 5/2000 Tabata et al. ..... 72/334
6,209,381 B1 * 4/2001 Yaguchi et al. ..... 72/416

FOREIGN PATENT DOCUMENTS

JP 58-125320 A 7/1983
JP 2935817 B2 8/1999

* cited by examiner

*Primary Examiner*—Dana Ross
*Assistant Examiner*—Mohammad Yusuf
(74) *Attorney, Agent, or Firm*—Sughrue Mion, PLLC

(57) ABSTRACT

A method of forming a chamfered through hole having a chamfered portion at each end thereof by: forming a prepared hole in a plate-like portion; forming a first chamfered portion by driving a first punch; forming a second chamfered portion by driving a second punch, which has a second tapered surface and a generally columnar central pressing portion protruding from the center of the second tapered surface and having an annular corner at a tip thereof, and thereby forming the second chamfered portion and a central recess recessed axially inward; and punching out an unnecessary portion protruding radially inward of the prepared hole by using a finishing punch having an outer diameter equal to or smaller than that of the corner of the central pressing portion. The punching out the unnecessary portion is performed by punching from the first chamfered portion toward the second chamfered portion using the finishing punch.

5 Claims, 15 Drawing Sheets

MEMBER HAVING A CHAMFERED THROUGH HOLE AND MANUFACTURING METHOD OF THE SAME

The disclosure of Japanese Patent Application No. 2007-249141 filed on Sep. 26, 2007 including the specification, drawings and abstract is incorporated herein by reference in its entirety.

BACKGROUND OF THE INVENTION

1. Field of the Invention

The present invention relates to a manufacturing method of a member having a chamfered through hole having a chamfered portion in peripheral corners located at each end of the through hole.

2. Description of the Related Art

For example, in a carrier cover of an automobile automatic transmission (A/T) or other various mechanical parts, a chamfered through hole having a chamfered portion in peripheral corners located at each end of the through hole is sometimes provided in a plate-like portion of the part.

Such a chamfered through hole is provided by, for example, a method disclosed in Japanese Patent Application Publication No. JP-A-S58-125320.

First, as shown in FIG. 12, a prepared-hole punching step is performed to form a prepared hole 90 extending through a plate-like portion 9 of a part by using a die 80 having a cut hole 800 and a punch 81.

Next, as shown in FIG. 13, the rear surface of the plate-like portion is supported by a stage 82, and a chamfering punch 83 having a pressing surface 830 corresponding to a desired chamfering shape is driven into the prepared hole 90 from its one end to form a first chamfered portion 91. With formation of the first chamfered portion 91, a burr-like unnecessary portion 94 protruding radially inward is formed inside the prepared hole 90.

Next, as shown in FIG. 14, the rear surface of the plate-like portion 9 is supported by a die 84 having a cut hole 840, and a finishing punch 85 is inserted into the prepared hole from the first chamfered portion 91 side to punch out the unnecessary portion 94. A finished hole 93 is thus formed.

Then, as shown in FIG. 15, the plane of the finished hole 93 having the first chamfered portion 91 is supported by a stage 86, and a chamfering punch 87 having a pressing surface 870 corresponding to a desired chamfering shape is driven against the periphery of the opposite end of the finished hole 93 to form a second chamfered portion 92. Formation of the chamfered through hole is thus completed. Note that, in order to form the second chamfered portion 92, a mold structure is designed so that generation of an unnecessary portion extending inward of a hole is suppressed to an acceptable level. In order to finish the finished hole 93 with higher accuracy, a cutting process may be performed as required.

In the above known method, formation of the finished hole 93 by the finishing punch 84 needs to be performed between the two chamfered-portion forming steps. It is more advantageous for cost reduction of the manufacturing process to perform the two chamfered-portion forming steps successively or simultaneously. However, it is practically difficult. If punching by the finishing punch is performed after the two chamfered portions are formed, appropriate support cannot be obtained with a die as shown in a comparative example (see FIG. 11) to be explained later. As a result, a shearing position may extend and a required portion may also be removed. Moreover, a sheared shape may become rugged instead of being circular, which is aesthetically problematic.

These problems can be solved by directly supporting the chamfered portion by a conically protruding die having a cut hole in the center. However, this method is problematic in terms of the fabrication cost and durability of the die.

SUMMARY OF THE INVENTION

The present invention is made in view of the above known problems, and it is an object of the present invention to provide a manufacturing method of a member having a chamfered through hole, in which a burr-like unnecessary portion on the inner periphery of the through hole can be removed by a pressing process after a chamfered portion is formed at each end of the through hole.

A first aspect of the present invention relates to a method for manufacturing a member having a chamfered through hole having a chamfered portion in peripheral corners located at each end of the through hole. In order to form the chamfered through hole, the method includes: forming in a plate-like portion a prepared hole extending through the plate-like portion (prepared-hole punching step); forming a first chamfered portion by driving a first punch, which has a first tapered surface inclined corresponding to a desired chamfering shape, into the prepared hole from one side of the prepared hole, and thereby forming the first chamfered portion by the first tapered surface (first chamfering step); forming a second chamfered portion by driving a second punch, which has a second tapered surface inclined corresponding to a desired chamfering shape and a generally columnar central pressing portion protruding from a center of the second tapered surface and having an annular corner at a tip thereof, into the prepared hole from another end of the prepared hole, and thereby forming the second chamfered portion by the second tapered surface and forming a central recess recessed axially inward from a center of the second chamfering portion by the central pressing portion (second chamfering step); and a punching out an unnecessary portion protruding radially inward of the prepared hole as a result of the first chamfering step and the second chamfering step by using a finishing punch having an outer diameter equal to or smaller than that of the corner of the central pressing portion (punching finishing step). The punching finishing step is performed by punching from the first chamfered portion toward the second chamfered portion using the finishing punch.

In the method for manufacturing a member having a chamfered through hole according to the present invention, at least the prepared-hole punching step, the first chamfering step, the second chamfering step, and the punching finishing step are performed. It should be noted that, in the second chamfering step, a special second punch is used to form the second chamfered portion having the central recess, and then the finishing punch is driven from the first chamfering portion toward the second chamfering portion to remove the unnecessary portion. The unnecessary portion can therefore be easily removed by a pressing process after the chamfering portions are formed at each end.

More specifically, a burr-like unnecessary portion protruding radially inward of the prepared hole is formed after the prepared-hole punching step, the first chamfering step, and the second chamfering step. As described above, in the second chamfering step, the second chamfered portion is formed by driving the second punch having the generally columnar central pressing portion protruding from the center of the second tapered surface. The central recess is therefore formed in the surface of the unnecessary portion located on the second-chamfered-portion side. Accordingly, a corner corresponding to the annular corner of the central pressing portion is formed at the intersection between the inner peripheral surface and the bottom surface of the central recess.

Next, in the punching finishing step, the unnecessary portion is punched out from the first chamfered portion toward the second chamfered portion by using the finishing punch. The finishing punch used in this step has an outer diameter that is equal to or smaller than that of the corner of the central pressing portion, that is, the corner of the central recess. When the unnecessary portion is pressed by the finishing punch, stress is therefore intensively applied to an outer peripheral end of the central recess on the second-chamfered-portion side. As a result, an outer peripheral shearing position on the second-chamfered-portion side of the unnecessary portion is aligned with the corner located at the outer peripheral end of the bottom surface of the central recess. Thus, cracking as a seared portion can be prevented from occurring outward of the corner. Moreover, since shearing occurs along the corner, a uniform shearing shape close to a circular shape can be obtained.

Since such excellent functions can be obtained, it is not necessary to support the second chamfered portion in direct contact with a die or the like in the punching finishing step. Accordingly, a die or the like having a normal shape and having a flat surface for supporting the surface of the plate-like portion can be employed, and therefore the cost for tools such as a die need not be increased significantly.

According to the present invention, a manufacturing method of a member having a chamfered through hole, in which a burr-like unnecessary portion on the inner periphery of the through hole can be removed by a pressing process after a chamfered portion is formed at each end of the through hole, can thus be provided.

A second aspect of the present invention relates to a member including a plate-like portion having a chamfered through hole having a chamfered portion in peripheral corners located at each end of the through hole. The member is manufactured by the manufacturing method according to the first aspect of the present invention.

The member having the chamfered through hole according to the present invention can be manufactured by the highly excellent manufacturing method described above. As a result, the manufacturing cost is reduced, whereby an inexpensive, high quality member can be obtained.

DETAILED DESCRIPTION OF THE EXEMPLARY EMBODIMENTS

Figure 1:
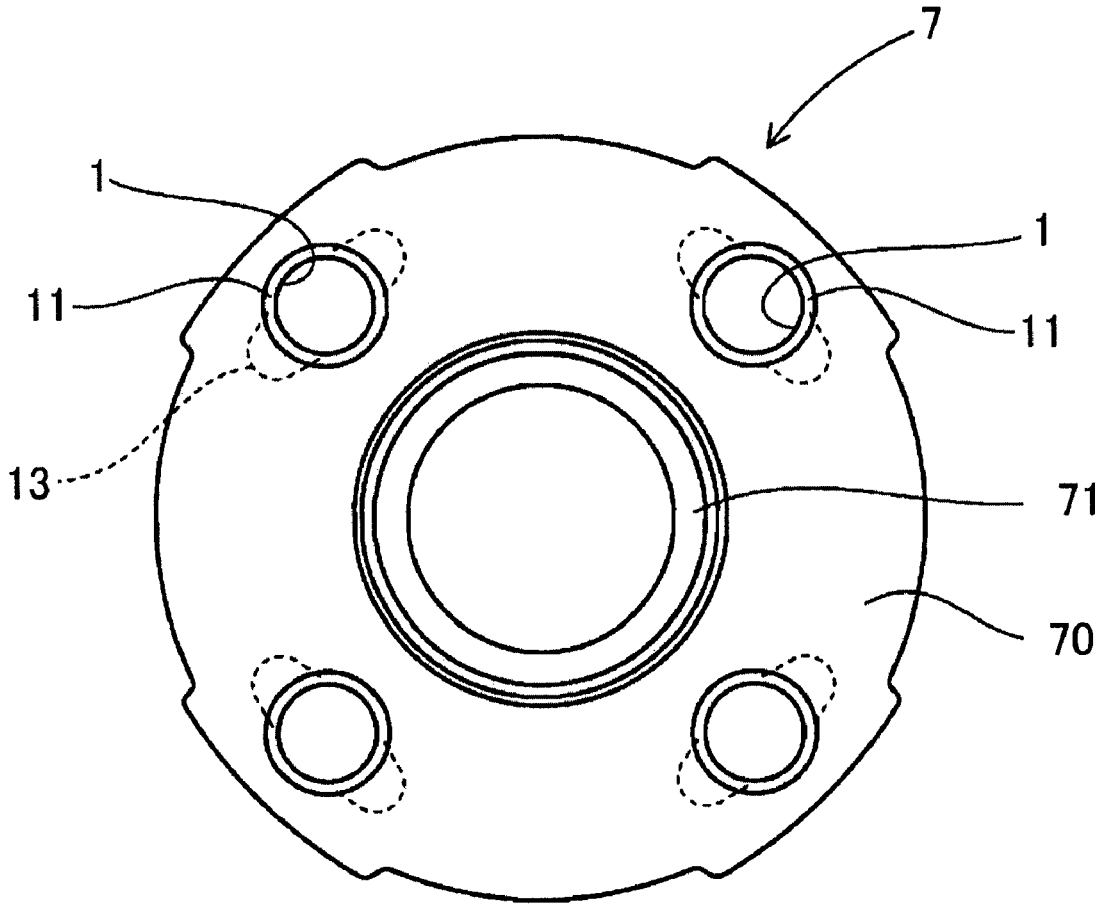
FIG. 1 is a diagram illustrating a shape of a carrier cover as a processed member having a plate-like portion according to a first exemplary embodiment.

In the present invention, at least the first prepared-hole punching step, the first chamfering step, the second chamfering step, and the punching finishing step are performed. A cutting finishing step may be added after the punching finishing step in order to improve accuracy of the inner diameter of the through hole.

As described above, a finishing punch having an outer diameter that is equal to or smaller than that of the corner of the central pressing portion is used in the punching finishing step. An optimal relation between the corner and the outer diameter of the finishing punch varies depending on the thickness and material of a plate-like portion, that is, a member to be processed. However, this relation can be easily confirmed by performing experiments by using finishing punches or second punches having different dimensions. The point is to ensure that the outer diameter of the finishing punch does not become larger than that of the corner and to reliably form the central recess.

In practical applications, the corner at the tip of the central pressing portion may be rounded (R-shaped) to some degree. It is rather preferable in view of the tool durability to provide an R shape having a radius of curvature of about 0.2 to 0.4 mm. If R is too large, intended stress concentration may not be obtained during shearing.

In the case where the first chamfering step and the second chamfering step are performed at separate timings, either the first chamfering step or the second chamfering step may be performed first. However, it is preferable to perform the first chamfering step and the second chamfering step simultaneously. In this case, the member to be processed, that is, the plate-like portion, can be processed while being interposed between the first punch and the second punch. The concentricity is therefore improved, whereby the processing can be performed more stably. Moreover, since two steps can be performed at a time, the manufacturing cost can be reduced.

At least one of the first tapered surface of the first punch and the second tapered surface of the second punch may have a dimple forming projection for forming a concave dimple portion in at least one of the first chamfered portion and the second chamfered portion. In the case where the dimple portion is formed, a larger amount of unnecessary portion is generated as compared to the case where only the chamfered portions are formed. The method of the present invention is therefore particularly effective.

Preferably, a side surface of the central pressing portion is inclined at 15° or less with respect to an axial direction so that the central pressing portion is reduced in diameter toward a tip thereof. The effects of the present invention can be obtained even when the inclination angle of the side surface is 0°. However, the second chamfering step and the punching finishing step can be more smoothly performed when the side surface is tilted. It should be noted that, in the case where the inclination angle exceeds 15°, the effect of stress concentration in the punching finishing step may be reduced. Moreover, if the inclination angle is too small, the effect of providing the inclination is small. The inclination angle is therefore more preferably in the range of 3° to 10°.

First Exemplary Embodiment

A manufacturing method of a member having a chamfered through hole according to an exemplary embodiment of the present invention will now be described with reference to FIGS. 1 through 10.

In this exemplary embodiment, chamfered through holes 1 are formed in a plate-like portion 70 of a carrier cover 7 that is a member of an automobile automatic transmission (A/T).

Figure 2:
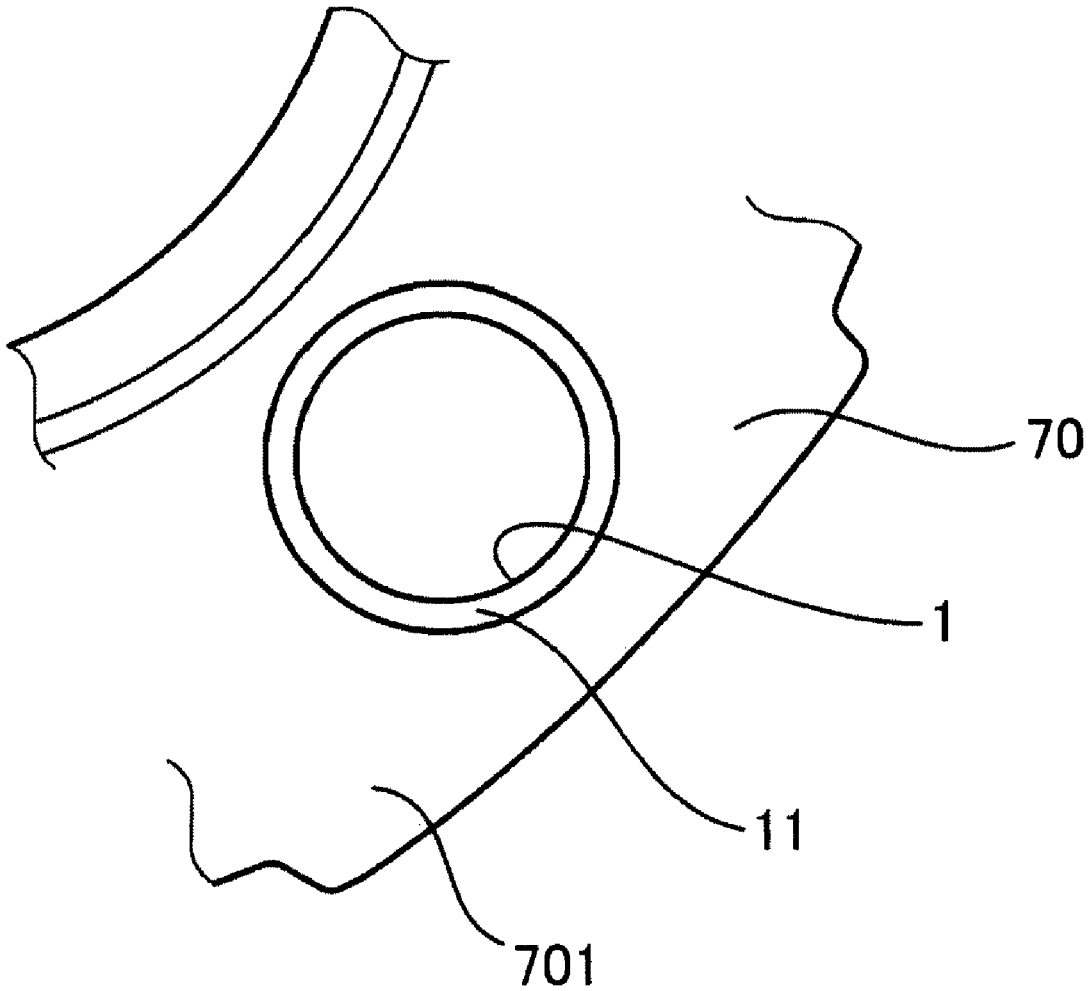
FIG. 2 is a diagram illustrating a shape of a chamfered portion on the front surface side of a chamfered through hole provided in the plate-like portion according to the first exemplary embodiment.
Figure 3:
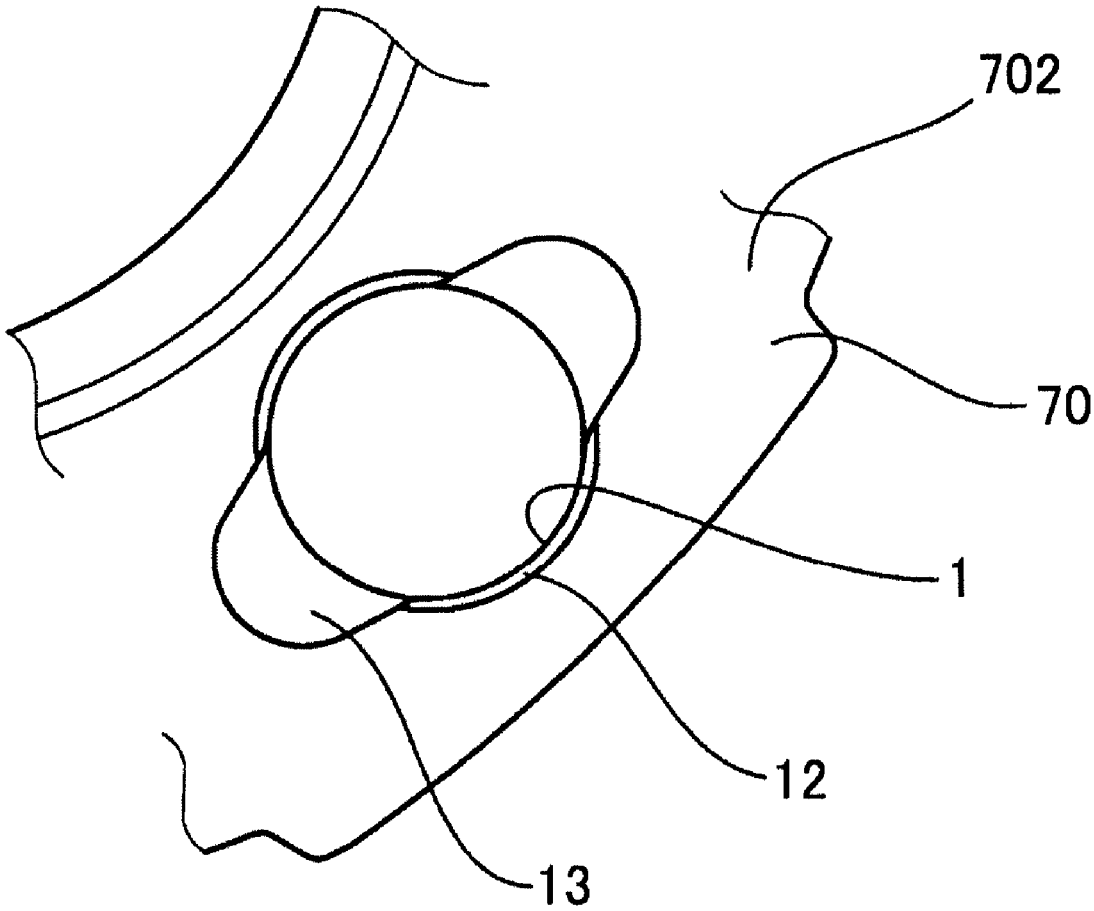
FIG. 3 is a diagram illustrating a shape of a chamfered portion on the rear surface side of the chamfered through hole provided in the plate-like portion according to the first exemplary embodiment.

The carrier cover 7 has a cylindrical portion 71 splined on its inner periphery and the chamfered through holes 1 extending through a disc-shaped plate-like portion 70 provided around the cylindrical portion 71. Each chamfered through hole 1 has a chamfered portion 11 on one surface 701 side of the plate-like portion 70 as shown in FIG. 2, and has a chamfered portion 12 and a dimple portion 13 on the other surface 702 side as shown in FIG. 3.

In order to form the chamfered through holes 1, a prepared-hole punching step, a first chamfering step and a second chamfering step, and a punching finishing step are performed as shown in FIGS. 4 through 7.

Figure 4:
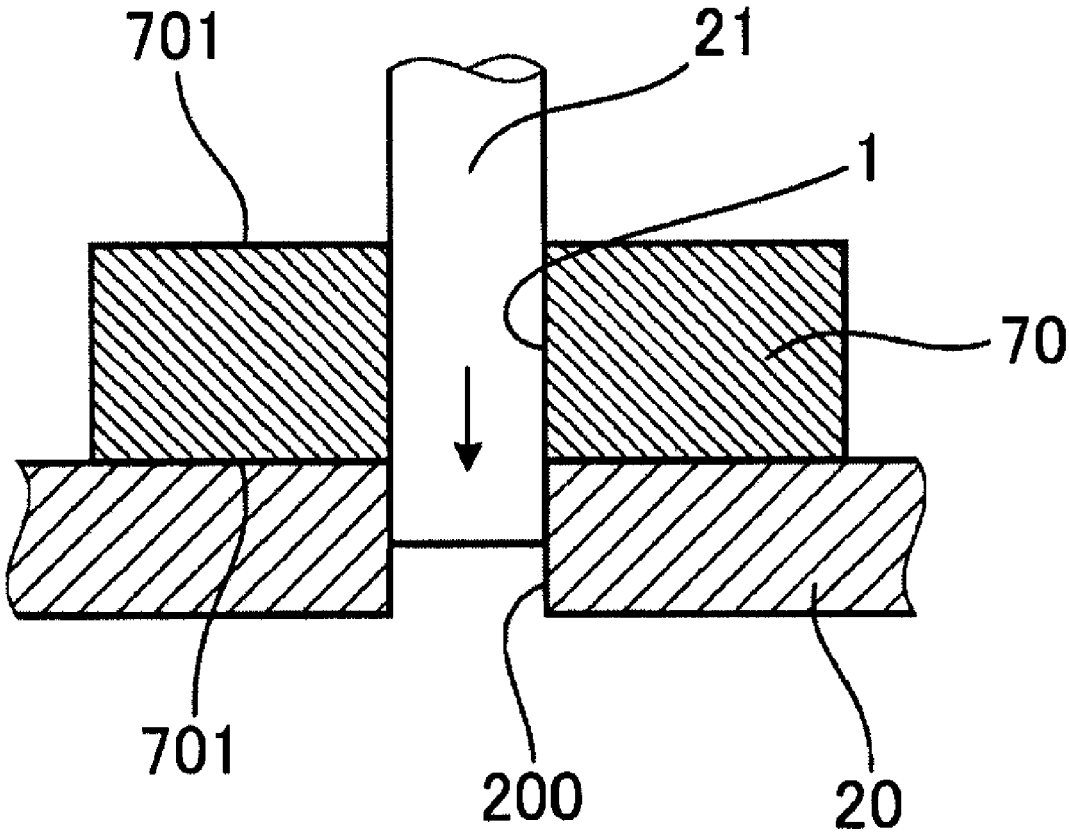
FIG. 4 is a diagram illustrating a method for performing a prepared-hole punching step according to the first exemplary embodiment.

First, as shown in FIG. 4, in the prepared-hole punching step, the plate-like portion 70 is placed on a die 20 having a cut hole 200, and is punched by a punch 21 to form a prepared hole 10 extending through the plate-like portion 70.

Figure 5:
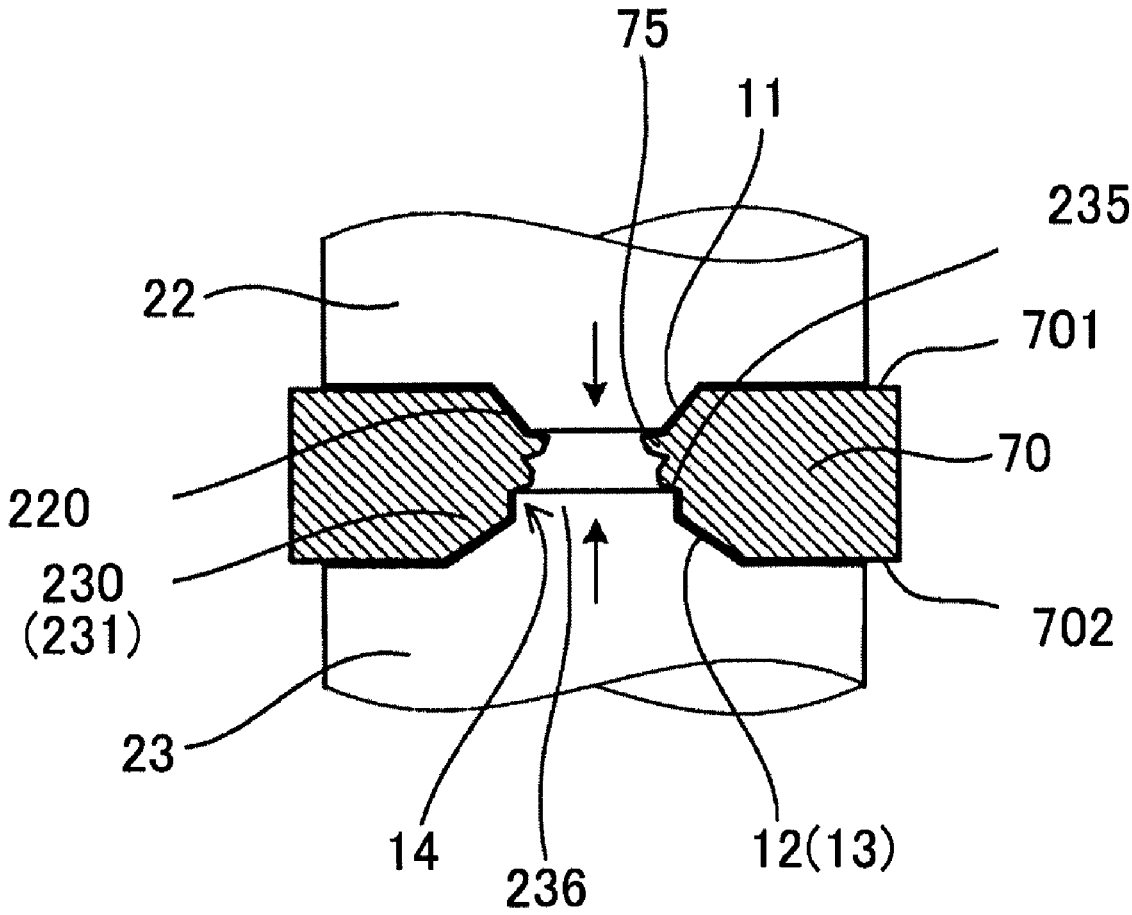
FIG. 5 is a diagram illustrating a method for performing a first chamfering step and a second chamfering step according to the first exemplary embodiment.

Then, as shown in FIG. 5, the first chamfering step and the second chamfering step are performed simultaneously.

In the first chamfering step, a first punch 22 having a first tapered surface 220 inclined corresponding to a desired chamfering shape is driven into the prepared hole 10 from one end thereof (from the surface 701 side) to form a first chamfered portion 11 by the first tapered surface 220.

Figure 6:
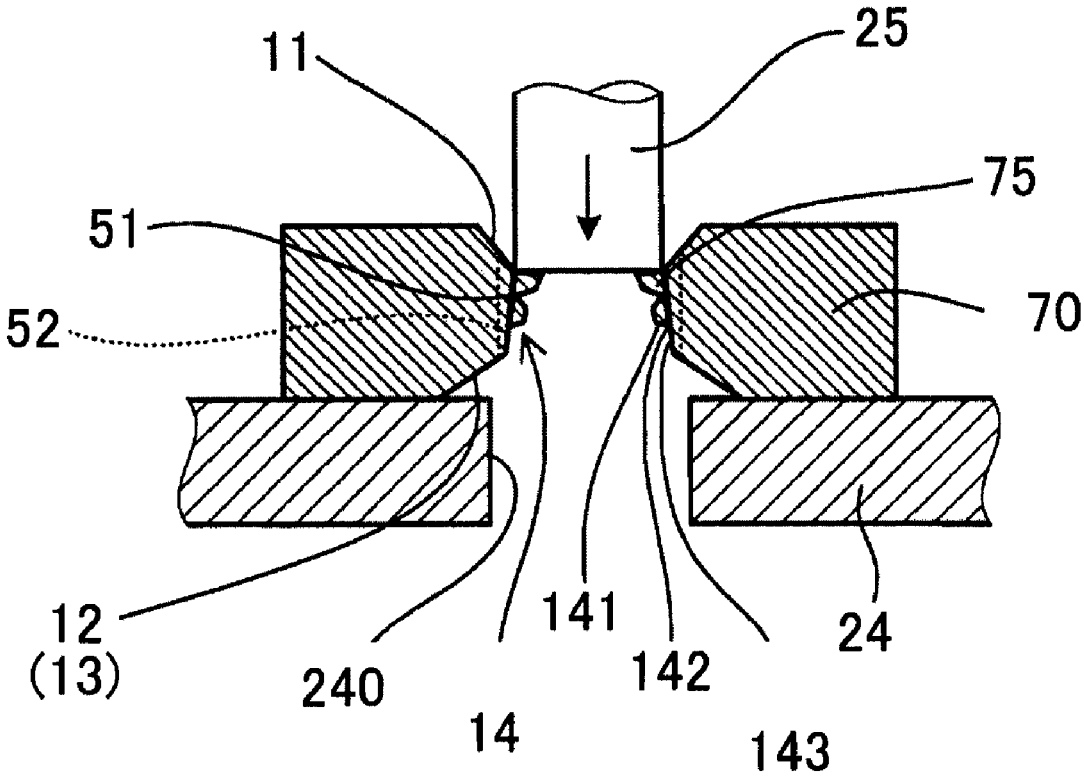
FIG. 6 is a diagram illustrating an early stage of a punching finishing step according to the first exemplary embodiment.
Figure 8:
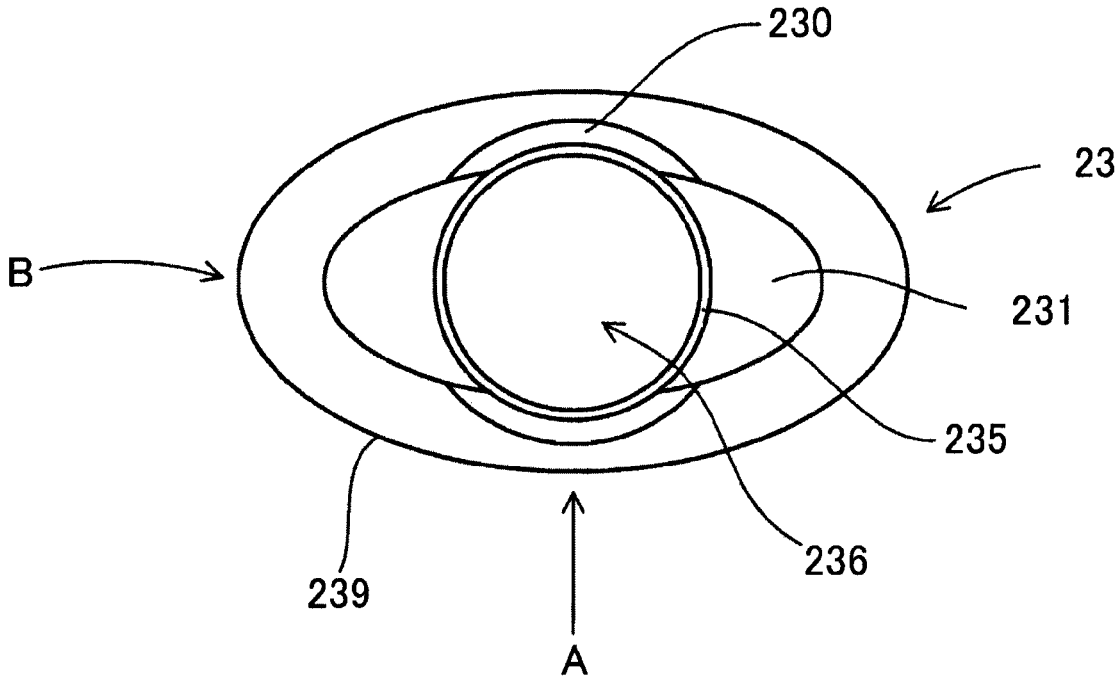
FIG. 8 is a diagram illustrating a shape of a second punch according to the first exemplary embodiment when viewed from a tip thereof.
Figure 9:
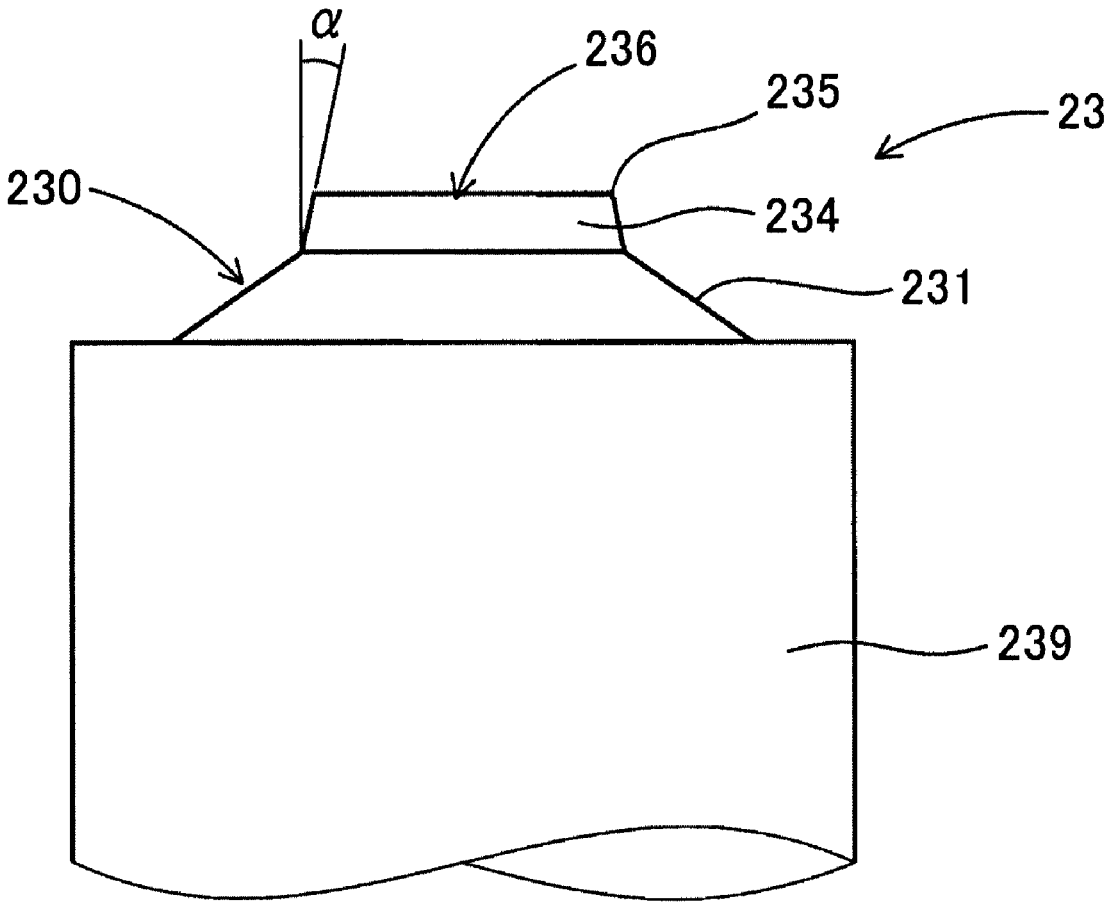
FIG. 9 is a diagram illustrating a side shape of the second punch according to the first exemplary embodiment when viewed from the direction of arrow A in FIG. 8.
Figure 10:
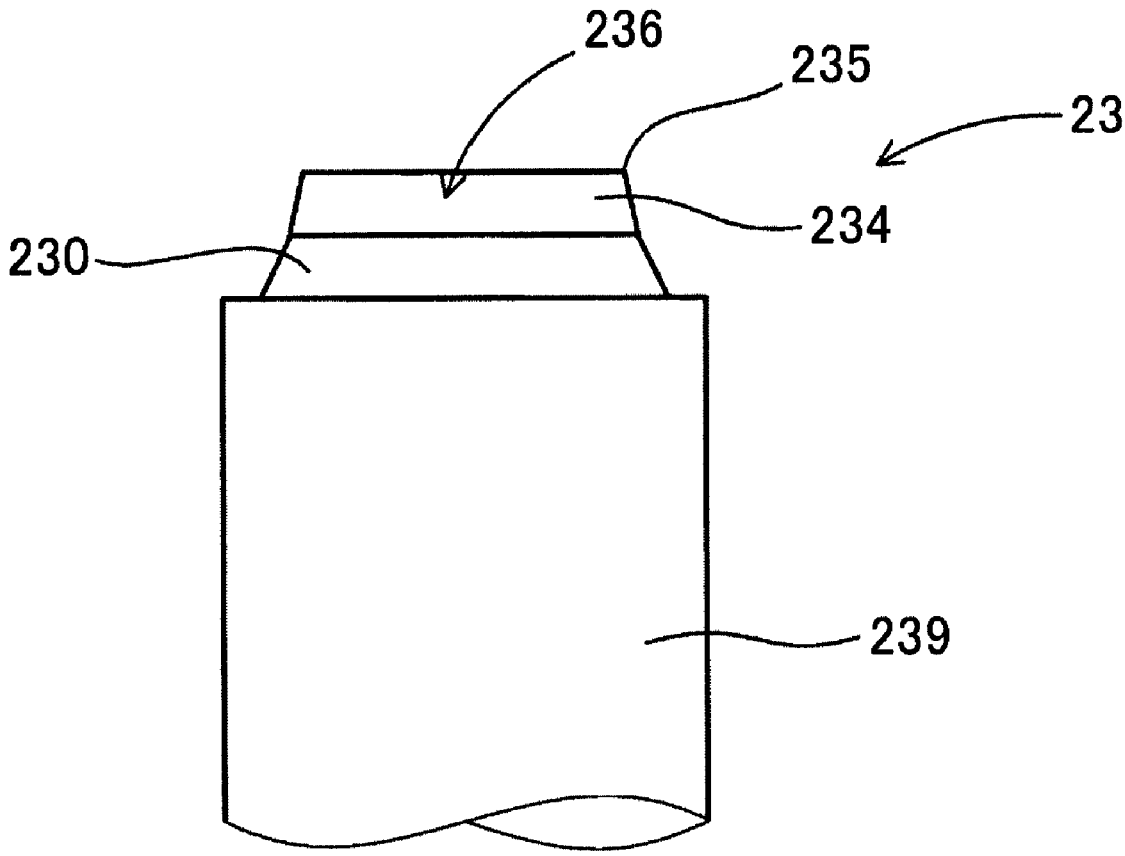
FIG. 10 is a diagram illustrating a side shape of the second punch according to the first exemplary embodiment when viewed from the direction of arrow B in FIG. 8.

As shown in FIGS. 8 through 10, a second punch 23 used in the second chamfering step has a second tapered surface 230 inclined corresponding to a desired chamfering shape at the tip of an oval body portion 239. The second punch 23 also has dimple forming protrusions 231 formed at two positions in a circumferential direction, and a generally columnar central pressing portion 236 protruding from the center of the second tapered surface 230 and having an annular corner 235 at the tip thereof. As shown in FIG. 5, in the second chamfering step, the second punch 23 is driven into the prepared hole 10 from the other end thereof (from the surface 702 side). A second chamfered portion 12 and a dimple portion 13 are thus formed by the second tapered surfaced 230 and the dimple forming protrusions 231, and a central recess 14 recessed axially inward from the center of the second chamfered portion 12 is formed by the central pressing portion 236. As shown in FIG. 6 described below, the central recess 14 has an annular corner 142 at the intersection between a ring-shaped side surface 143 and a bottom surface 141.

In this exemplary embodiment, the first chamfering step and the second chamfering step are performed simultaneously by interposing the plate-like portion 70 between the first punch 22 and the second punch 23.

Figure 7:
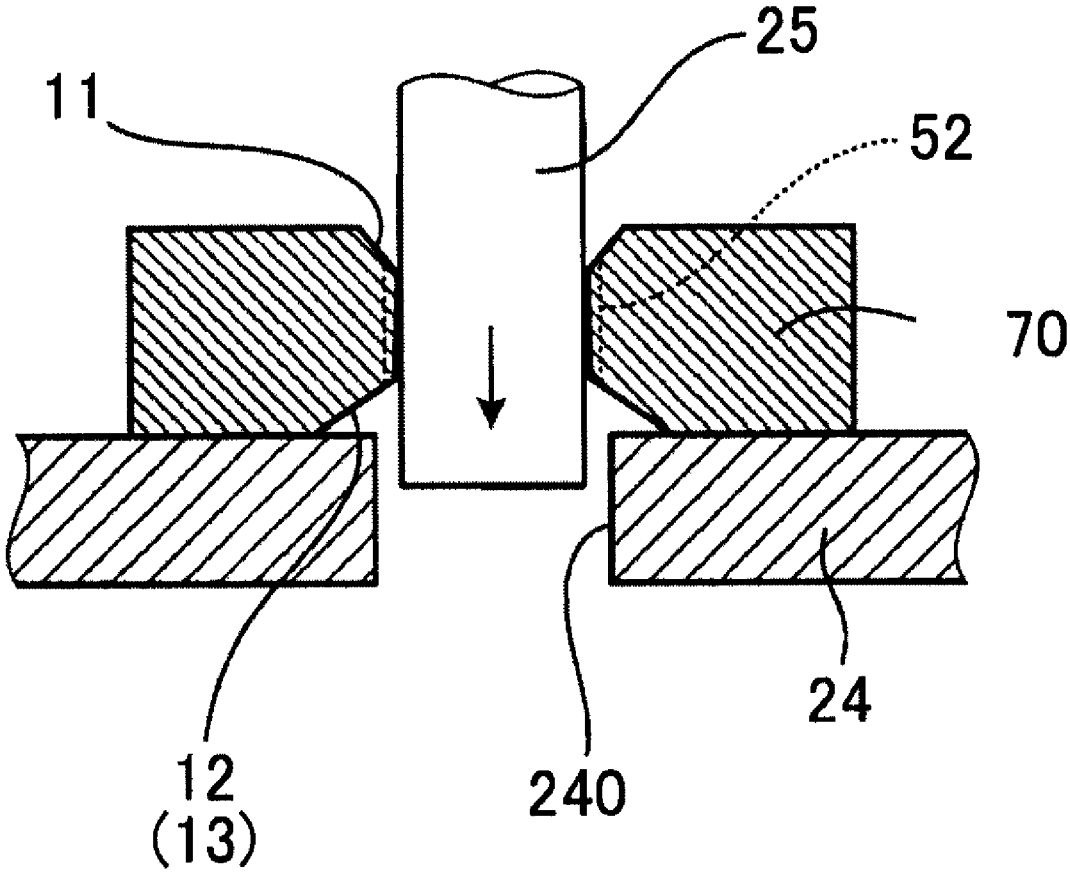
FIG. 7 is a diagram illustrating an end stage of the punching finishing step according to the first exemplary embodiment.

Next, as shown in FIGS. 6 and 7, the punching finishing step is performed. In the punching finishing step, the plate-like portion 70 is supported on a die 24 having a through hole 240 on the rear surface thereof, and a finishing punch 25 having an outer diameter slightly smaller than that of the corner 235 of the central pressing portion 236 is driven from the first chamfered portion 11 toward the second chamfered portion 12 (13) to punch out an unnecessary portion 75.

As shown in FIG. 6, shearing stress that is applied from the finishing punch 25 advancing from the first chamfered portion 11 side is generated intensively toward a corner 141 of the central recess 14 on the rear surface side of the unnecessary portion 75. A shearing position 51 is thus determined toward the corner 141. As shown in FIG. 7, therefore, the shearing position can be kept within a desired range after the finishing punch 25 punches out the unnecessary portion 75. For example, in this exemplary embodiment, the corner 141 is provided inside a cutting position 52 at which a final cutting process is performed, whereby the shearing position 51 can be controlled to a position inside the cutting position 52.

First Comparative Example

Figure 11:
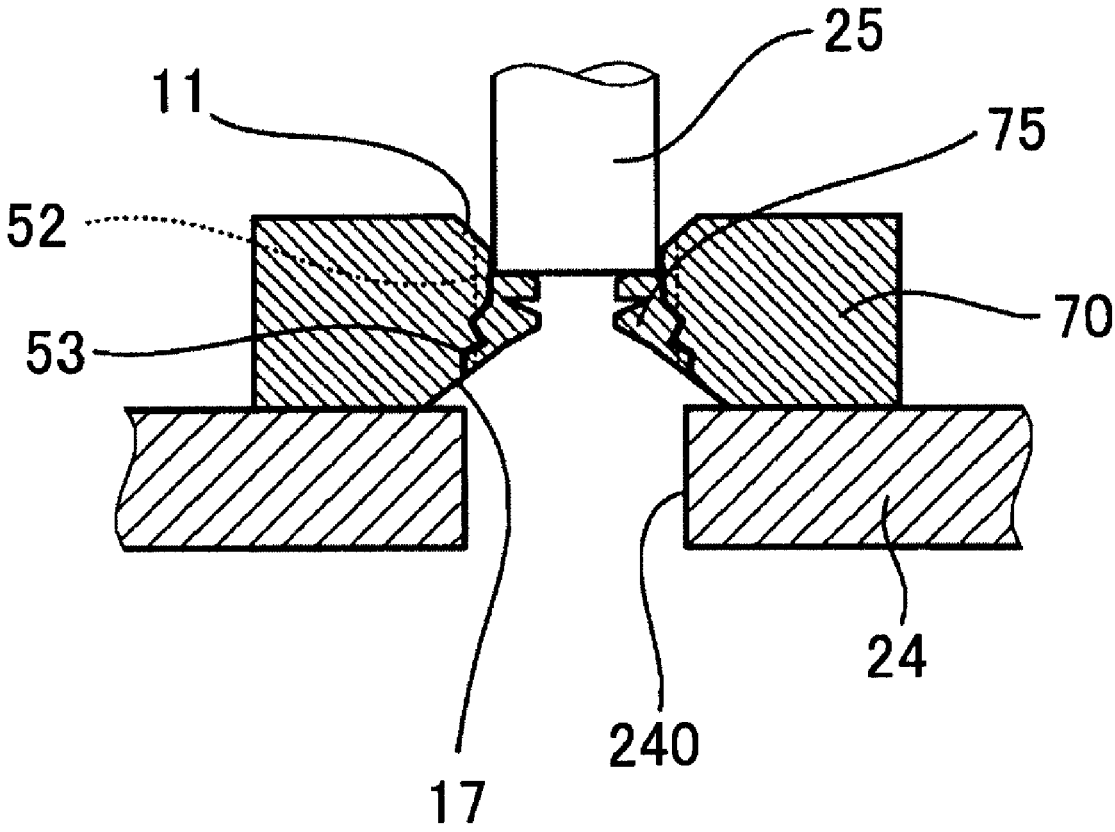
FIG. 11 is a diagram illustrating an early stage of a punching finishing step in a first comparative example.
Figure 12:
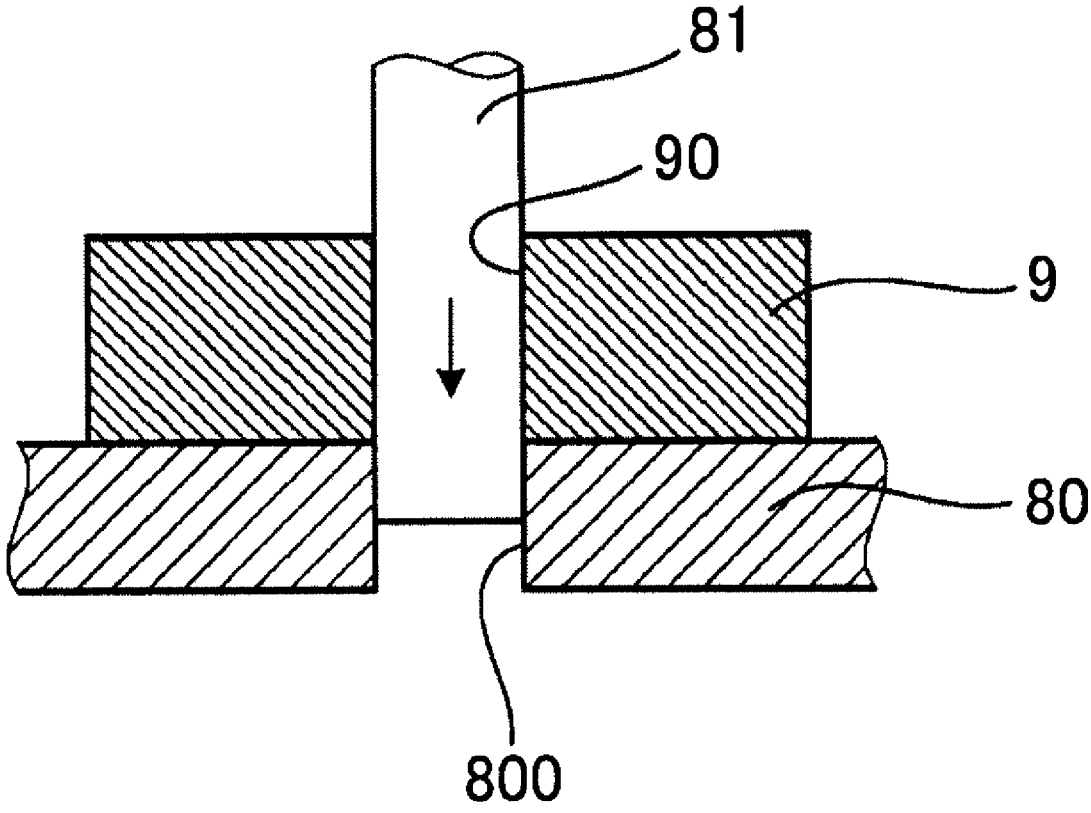
FIG. 12 RELATED ART
FIG. 12 is a diagram illustrating a method for performing a prepared-hole punching step in a related art example.
Figure 13:
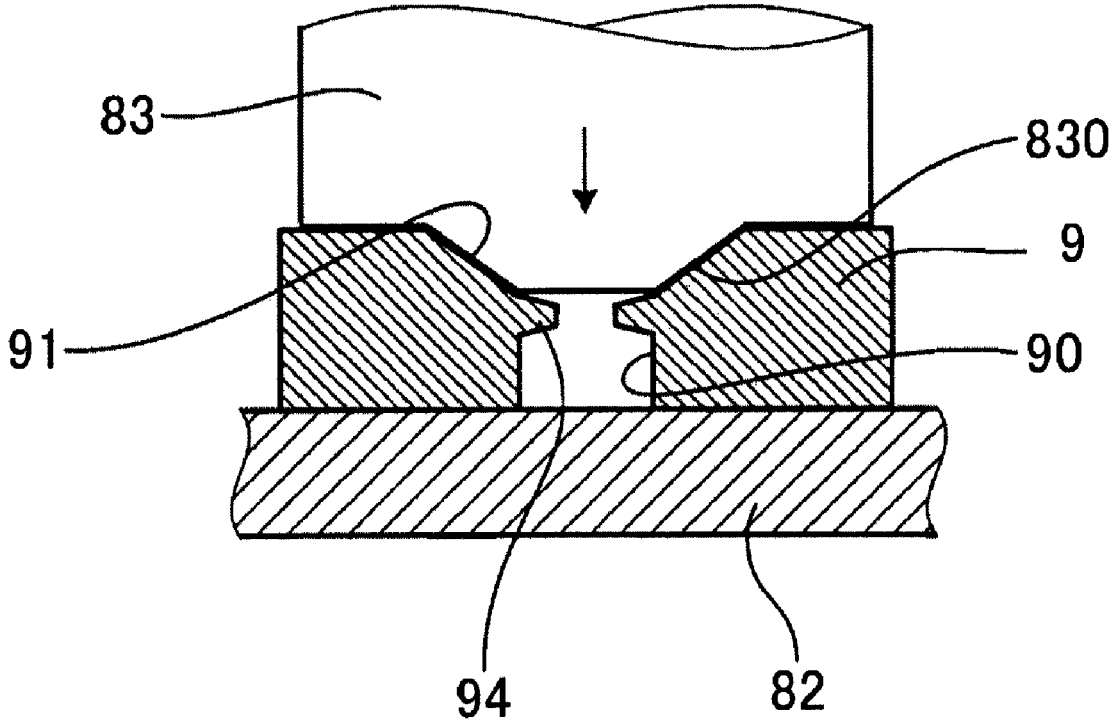
FIG. 13 RELATED ART
FIG. 13 is a diagram illustrating a method for performing a first chamfering step in the related art example.
Figure 14:
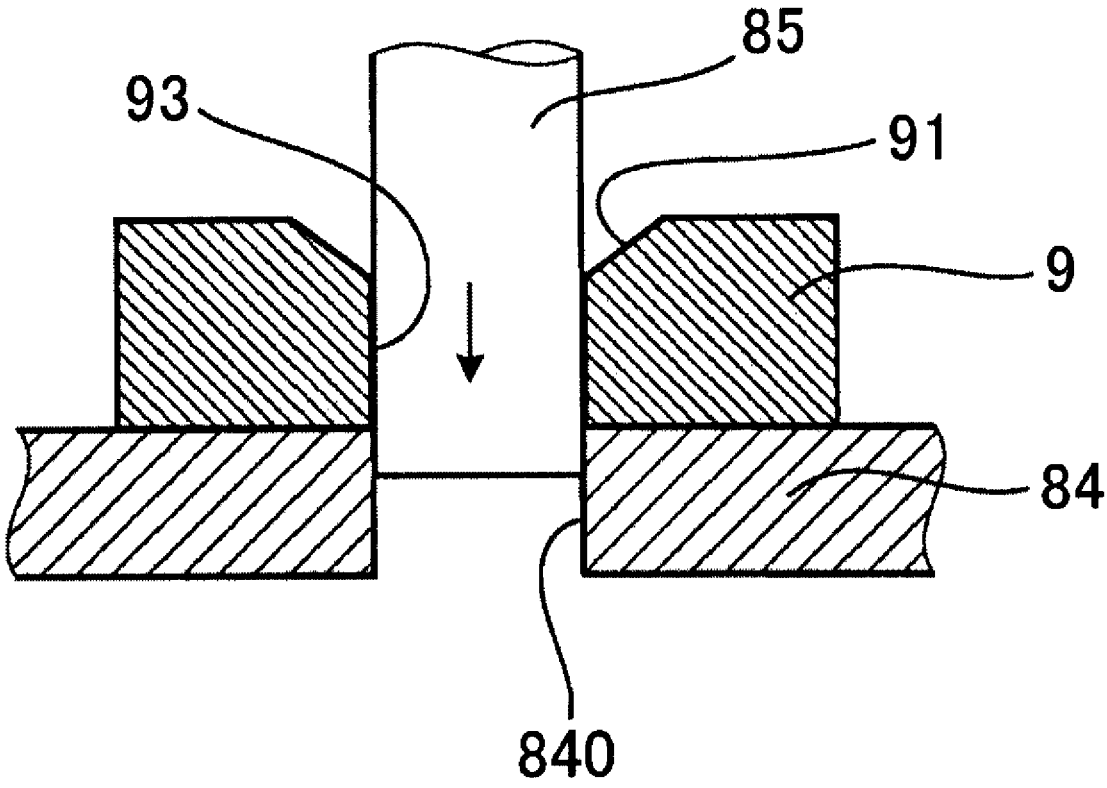
FIG. 14 RELATED ART
FIG. 14 is a diagram illustrating an end stage of the punching finishing step in the related art example.
Figure 15:
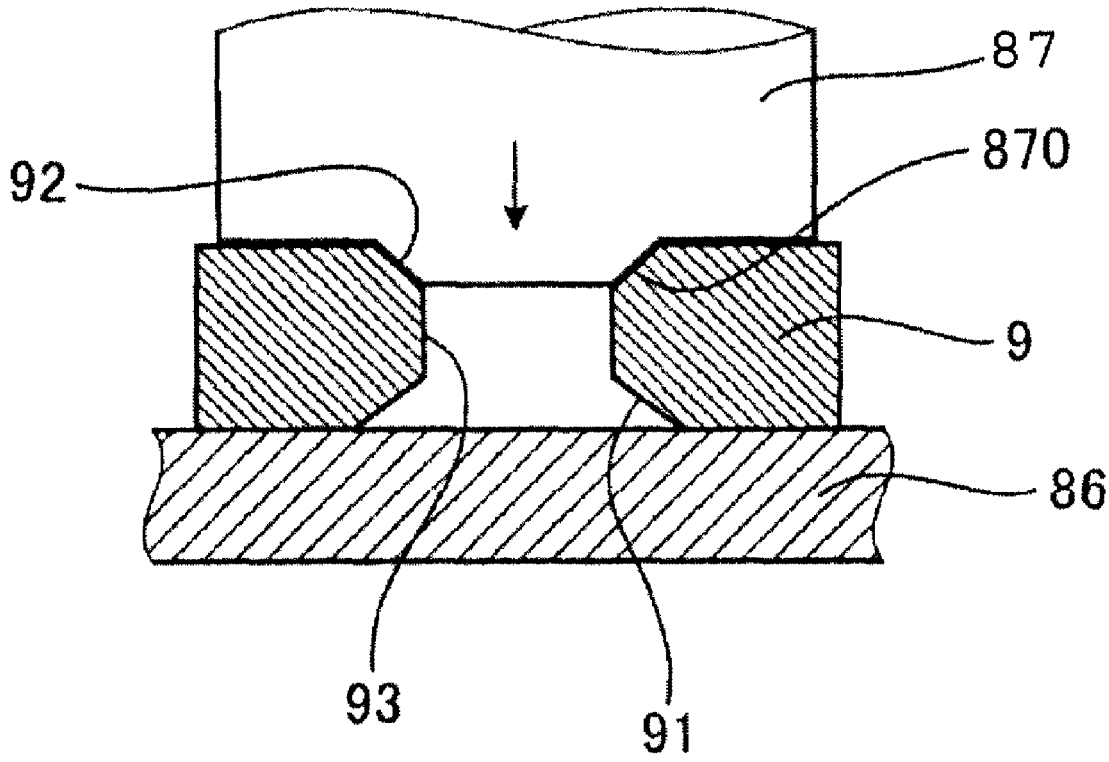
FIG. 15 RELATED ART
FIG. 15 is a diagram illustrating a method for performing a second chamfering step in the related art example.

In order to more clarify the effects of the first exemplary embodiment, a test was performed as a first comparative example without providing the central recess 14 as shown in FIG. 11.

More specifically, a punch having no central pressing portion was used as the second punch in the second chamfering step, whereby a second chamfered portion 17 having no central recess was formed as shown in FIG. 11. As shown in FIG. 11, the punching finishing step was performed by using the die 24 and the finishing punch 25 in the same manner as in the first exemplary embodiment.

As a result, as shown in FIG. 11, shearing stress applied from the finishing punch 25 was randomly transmitted to the rear surface of the unnecessary portion 75, whereby a shearing position 53 also extends randomly. The first comparative example had a problem that the shearing position 53 extended beyond the subsequent cutting position 52.

The above result shows that it is very effective to provide the central pressing portion 236 and the corner 235 in the second punch 23 and to provide the central recess 14 and the corner 142 in the rear surface of the unnecessary portion 75 as in the first exemplary embodiment.

Note that, as shown in FIG. 9, in the second punch 23 used in the first exemplary embodiment, a side surface 234 of the central pressing portion 236 is inclined at an angle $\alpha$ of 8° with respect to an axial direction so that the central pressing portion 236 is reduced in diameter toward the tip thereof. Such a specific angle and dimensions of the central pressing portion 2 can be selected as appropriate, and may be changed according to the thickness and material of the plate-like portion 70, the inner diameter of the chamfered through holes 1, or the like. Tool design needs to be performed through a trial and error process while carrying out tests. However, a shape having the central pressed portion always needs to be employed.

While this invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A method for manufacturing a member having a chamfered through hole having a chamfered portion in peripheral corners located at each end of the through hole, in order to form the chamfered through hole, the method comprising:

forming, in a plate-like portion, a prepared hole extending through the plate-like portion;

forming a first chamfered portion by driving a first punch, which has a first tapered surface inclined corresponding to a desired chamfering shape, into the prepared hole from one side of the prepared hole, and thereby forming the first chamfered portion by the first tapered surface;

forming a second chamfered portion by driving a second punch, which has a second tapered surface inclined corresponding to a desired chamfering shape and a generally columnar central pressing portion protruding from a center of the second tapered surface and having an annular corner at a tip thereof, into the prepared hole from another end of the prepared hole, and thereby forming the second chamfered portion by the second tapered surface and forming a central recess recessed axially inward from a center of the second chamfering portion by the central pressing portion; and punching out an unnecessary portion protruding radially inward of the prepared hole as a result of the forming the first chamfering portion and the forming the second chamfering portions using a finishing punch, having an outer diameter equal to or smaller than that of the corner of the central pressing portion, wherein the punching finishing step is performed by punching from the first chamfered portion toward the second chamfered portion using the finishing punch.

2. The method for manufacturing a member having a chamfered through hole according to claim 1, wherein the forming the first chamfered portion and the forming the second chamfered portion are performed simultaneously.

3. The method for manufacturing a member having a chamfered through hole according to claim 1, wherein at least one of the first tapered surface of the first punch and the second tapered surface of the second punch have a dimple forming projection for forming a concave dimple portion in at least one of the first chamfered portion and the second chamfered portion.

4. The method for manufacturing a member having a chamfered through hole according to claim 1, wherein a side surface of the central pressing portion is inclined at 15° or less with respect to an axial direction so that the central pressing portion is reduced in diameter toward a tip thereof.

5. A member including a plate-like portion having a chamfered through hole having a chamfered portion in peripheral corners located at each end of the through hole, wherein the member is manufactured by the manufacturing method according to claim 1.

* * * * *